US005087054A

United States Patent [19]

O'Neil

[11] Patent Number: 5,087,054

[45] Date of Patent: Feb. 11, 1992

[54] AMUSEMENT DUNKING APPARATUS

[75] Inventor: T. Scott O'Neil, Merrimac, Mass.

[73] Assignee: Dunk The Clown, Inc., Merrimac, Mass.

[21] Appl. No.: 669,044

[22] Filed: Mar. 14, 1991

[51] Int. Cl.[5] ..... A63B 63/00

[52] U.S. Cl. ..... 273/384

[58] Field of Search ..... 273/384

[56] References Cited

U.S. PATENT DOCUMENTS

| | | | |
|---|---|---|---|
| 1,021,019 | 3/1912 | VanKannel | 273/384 |
| 2,202,738 | 5/1940 | Keller | 273/384 |
| 4,466,616 | 8/1984 | Griego et al. | 273/384 |
| 4,943,064 | 7/1990 | Smith, Jr. | 273/384 |

*Primary Examiner*—William H. Grieb

*Attorney, Agent, or Firm*—Lahive & Cockfield

[57] ABSTRACT

A dunking apparatus, useful as an amusement device, is provided which is easily assembled, disassembled and transported. The apparatus comprises a control housing for enclosing at least part of a release mechanism, a load supporting platform and a fluid-retaining reservoir mounted upon a support platform. The apparatus also includes target-supporting walls hingedly connected to the housing which may be pivoted to lie flush against the remainder of the apparatus for disassembly, or pivoted to extend perpendicular to the remainder of the apparatus for operative assembly. The entire apparatus may be permanently mounted upon a wheel-based, mobile trailer.

The apparatus also includes an impact-activated release mechanism for releasing a load, such as a human, sitting upon the platform. The release mechanism is activated upon impact with a thrown object, such as a ball.

15 Claims, 5 Drawing Sheets

AMUSEMENT DUNKING APPARATUS

BACKGROUND OF THE INVENTION

The invention relates to an amusement device. More particularly, the invention concerns an object dunking apparatus in which an object is dropped upon impact-actuation of a release mechanism.

An amusement device which has long been popular at fairs, amusement parks and the like is a dunking machine. Typically, a person (sometimes dressed as clown) sits upon a load-supporting platform while patrons throw balls or other objects at one or more targets, attempting to activate a release mechanism. When the target is struck, the platform is caused to drop the person into water or some other fall-breaking material.

Many such dunking machines now in existence require time-consuming assembly procedures and are not easily transportable. Moreover, the release mechanisms of known machines are not always reliable. In some instances, a direct hit upon the target fails to release the platform. Conversely, a target miss sometimes causes enough vibration of the machine to induce release of the platform. There is thus a need for an easily assembled dunking apparatus which has a reliable release mechanism.

Accordingly, it is an object of the invention to provide a dunking apparatus which is quickly and easily assembled and disassembled. Another object is to provide a dunking apparatus which has a release mechanism actuated only upon impact of one or more targets. It is also an object to provide a dunking machine which operates safely. A further object of the invention is to provide a dunking apparatus having a release mechanism which is easily reset following actuation. Other objects will be apparent to one of ordinary skill in the art upon reading the disclosure which follows.

SUMMARY OF THE INVENTION

The present invention generally relates to an amusement device generally known as a "clown dunking" apparatus. A person dressed as a clown (or otherwise) sits atop a platform and is dropped into a reservoir when a target is struck by a ball or other object thrown by a patron. The dunking apparatus of this invention features an easily assembled construction as well as an improved release mechanism.

A dunking apparatus is provided which is easily and quickly assembled before use. The apparatus comprises a control housing which encloses portions of the release mechanism and within which operators of the apparatus may be positioned. A load-supporting platform is disposed forward of and adjacent to the control housing. A fluid or material reservoir is disposed beneath the platform. Preferably, a cage or protective screen surrounds the top, front and side portions of the reservoir and platform to protect any person who is to sit upon the platform while waiting to be dunked. The dunking apparatus also includes one or more target-supporting frames or walls which is attached to the control housing. In one embodiment, the frame is hingedly connected to the control housing and may be easily manipulated to its operative position. In yet another embodiment the entire apparatus may be mounted upon a wheel-based trailer so as to be easily transportable.

The release mechanism used with the dunking apparatus of the invention is designed to release the load-supporting platform to cause an object supported thereon (such as person) to be dropped when a target is subject to an impact force, such as would be caused by a thrown object. The release mechanism includes actuating members which communicate between each target and a horizontally oriented control bar. The control bar extends between targets and also has a locking mechanism mounted thereon. Preferably the locking mechanism is mounted on a central portion of the control bar. In addition, a support rod extends between the support platform and the locking mechanism to maintain the platform in the load-supporting condition. An impact force causing displacement of the target is communicated through the actuating member(s) to impart movement to the control apparatus, thus moving the locking mechanism from the load supporting to the load releasing position. In the load releasing position the support rod is released from the locking mechanism, causing the platform to be released as well, thereby dropping a person supported by the platform into the reservoir.

DETAILED DESCRIPTION OF THE INVENTION

Figure 1:
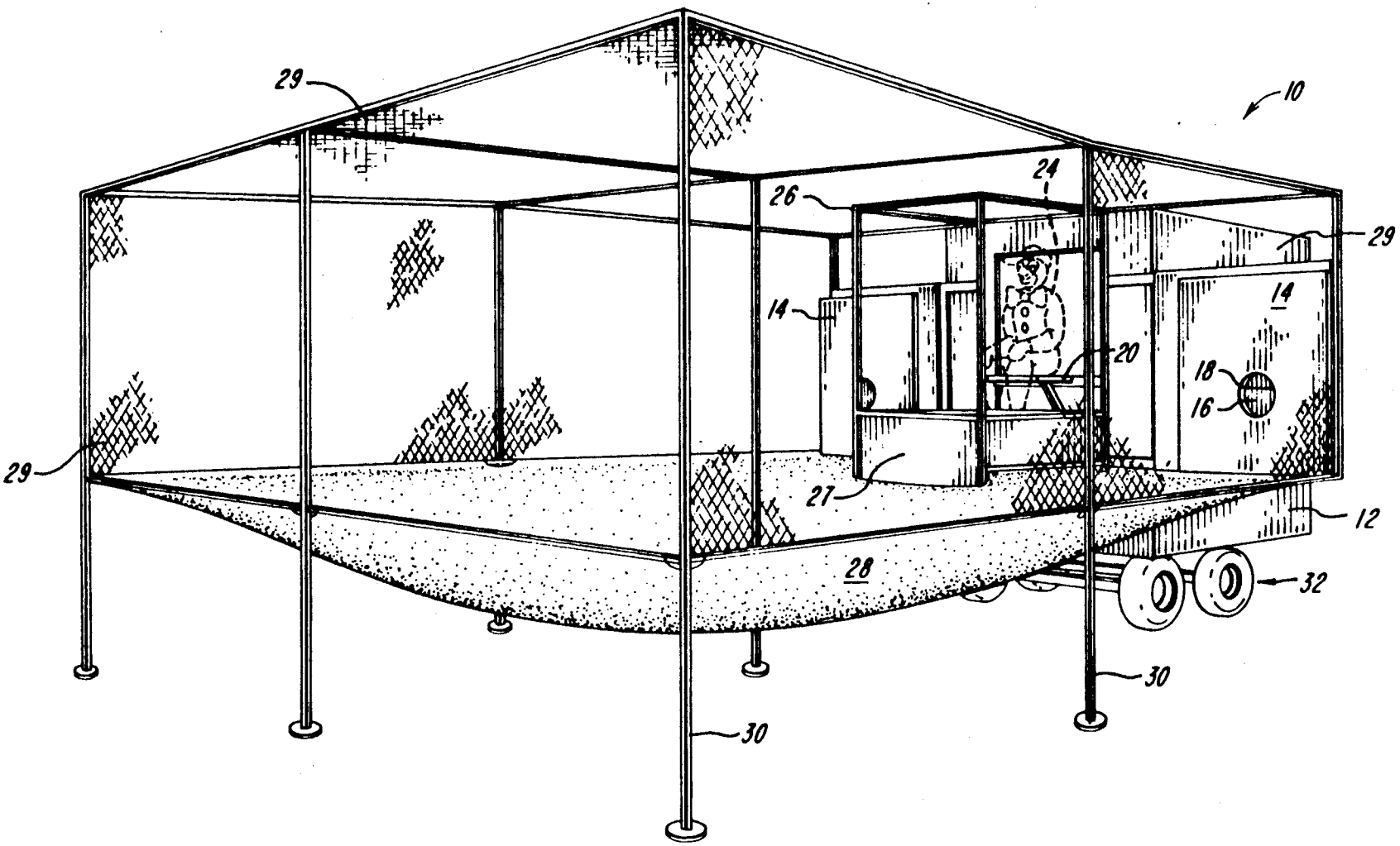
FIG. 1 is a perspective view showing the fully assembled dunking apparatus of the invention.

FIG. 1 illustrates a dunking apparatus 10 in its fully assembled and operative condition. Dunking apparatus 10 includes a control housing 12, and also has target supporting walls 14 which extend from either side of control housing 12. Target supporting walls 14 include a target 16 which is recessed within an aperture 18 disposed on the front side of target supporting wall 14. A load-supporting platform 20 is attached to and extends from a forward portion of control housing 10. Platform 20, with the assistance of a support rod 22, supports a load 24, such as a person. A reservoir 27, adapted to retain a fluid or other material suitable to break the fall of the load, is positioned directly beneath 20.

FIG. 1 further illustrates a protective enclosure 26 which surrounds the load or person 24 supported on platform 20. Enclosure 26 provides protection against thrown objects. Also, a netting material or membrane 28 extends forward of the control housing 12 and protective enclosure 26 in order to assist in collecting balls (not shown) or other objects which are thrown at targets 16. Netting material 28 may be supported by poles 30 which are disposed at suitable locations about the perimeter of the netting material. An additional netting material 29 may extend between poles 30 to enclose selected side and/or top portions of the apparatus. Upon disassembly of the apparatus, the netting 28, 29 may be folded and stored in a convenient manner, such as within or against control housing 12.

In one embodiment, the apparatus may be mounted upon a trailer assembly 32 in order to be easily transportable. Alternatively, the apparatus may be mounted upon a stationary platform.

Figure 2:
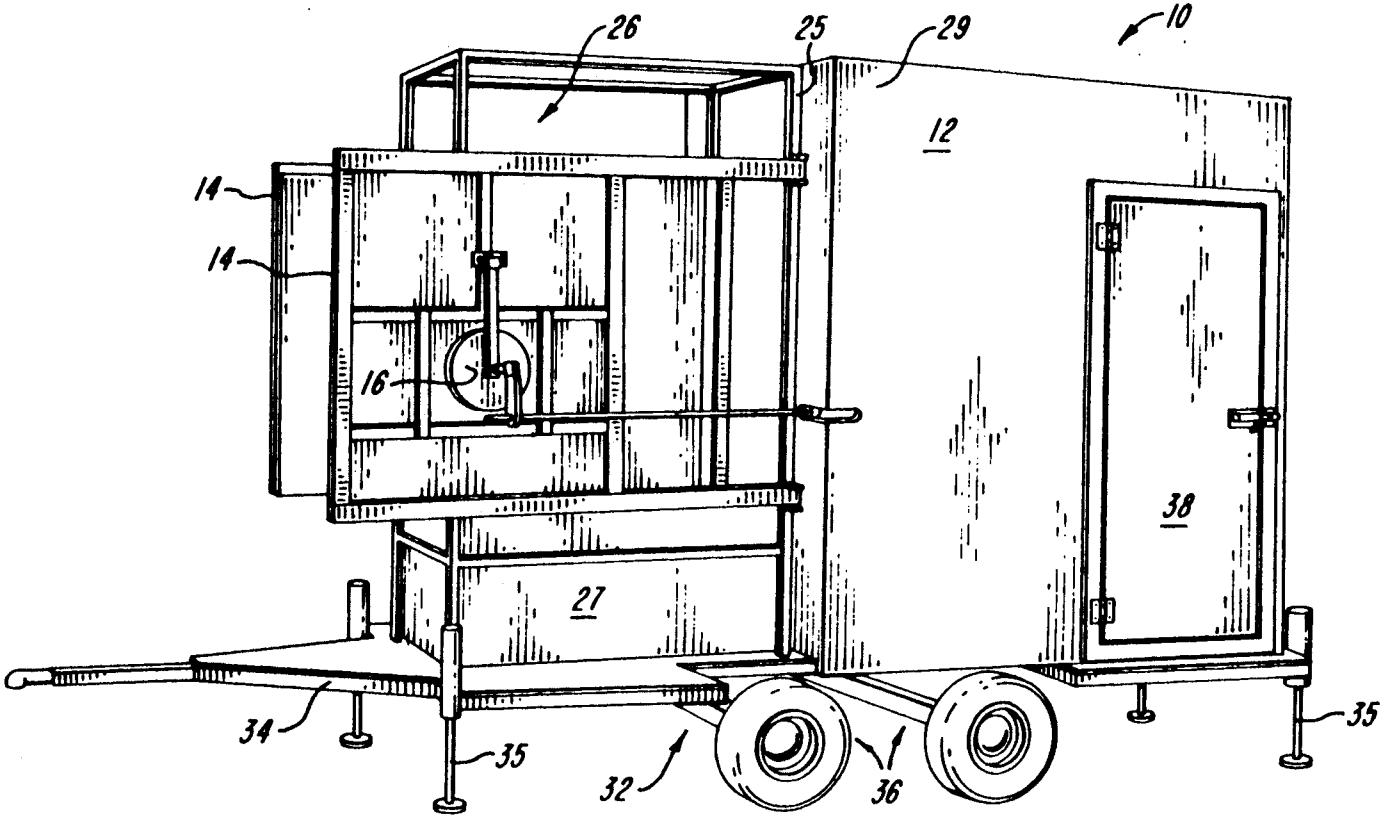
FIG. 2 is a perspective view showing the dunking apparatus of FIG. 1 in the disassembled condition.

FIG. 2 illustrates the dunking apparatus 10 of FIG. 1 in the disassembled condition in which it is suitable for easy transport. As shown, the control housing 12 and reservoir 27 are mounted upon a trailer platform 34 which, in turn, is mounted upon a trailer wheel assembly 36. Target supporting walls 14 are hingedly connected to control housing 12 (or to a rearward frame 25 of enclosure 26). As further shown in FIG. 2, walls 14 may be pivoted away from control housing to lie flush against protective enclosure 26 to be held in the disassembled position. Optionally, a door 38 may be provided to Provide security and to allow convenient access to control housing 12. Stabilizing members, such as retractable jacks 35, may be attached to the trailer platform 34.

The disassembled dunking apparatus illustrated in FIG. 2 may be conveniently towed by a vehicle. When necessary, the apparatus may be easily assembled by simply pivoting the target supporting walls 14 outwardly to extend perpendicular to the side walls 29 of the control housing 12 and protective enclosure 26. Next, poles 30 and netting material 28, 29 may be placed in their operative position as illustrated in FIG. 1. The apparatus is ready for use once the reservoir is filled with a fluid, such as water, and the release mechanism is placed in its operative condition.

Figure 3:
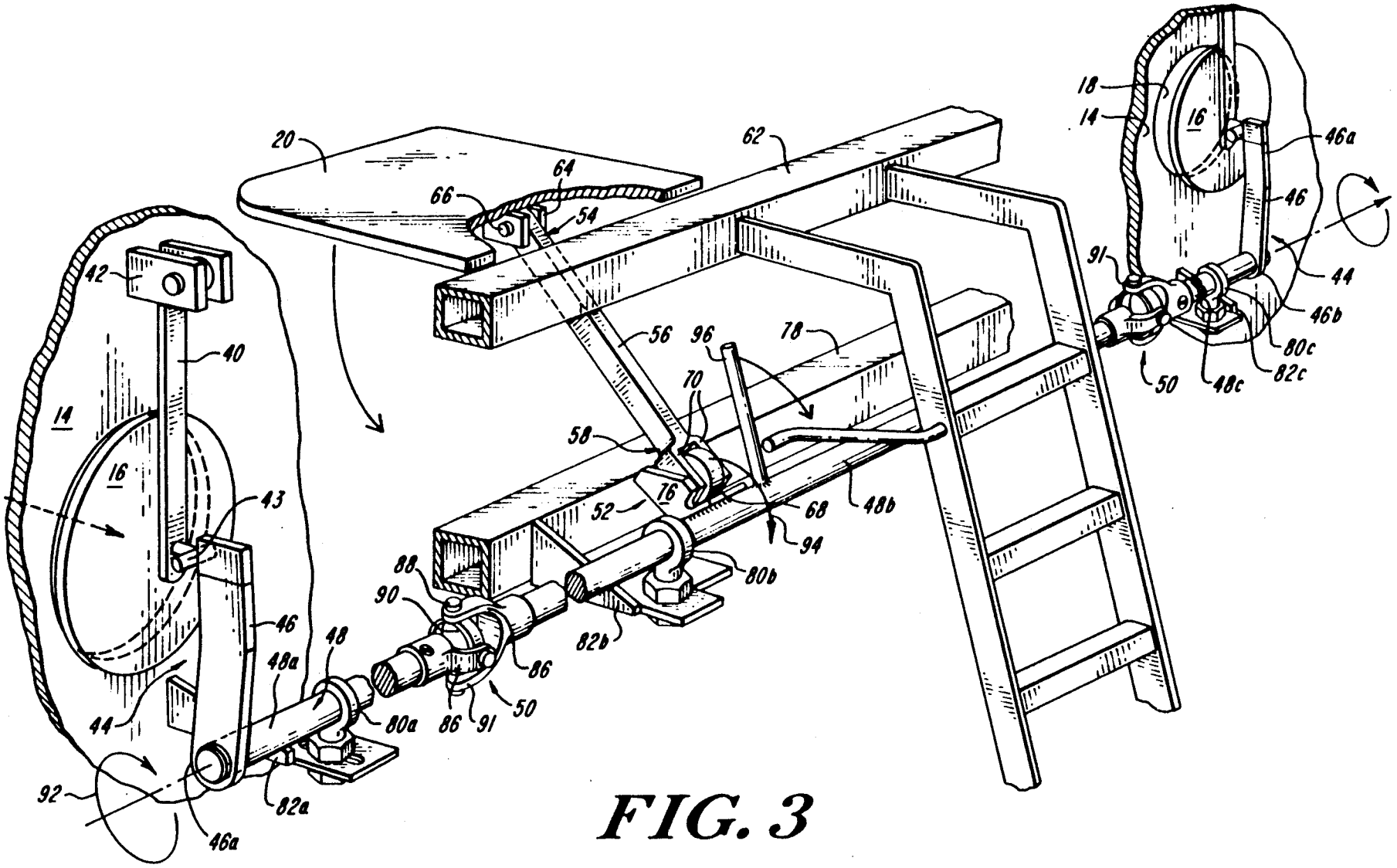
FIG. 3 is a rear, perspective view of the release mechanism of the dunking apparatus illustrated in FIGS. 1 and 2.
Figure 4:
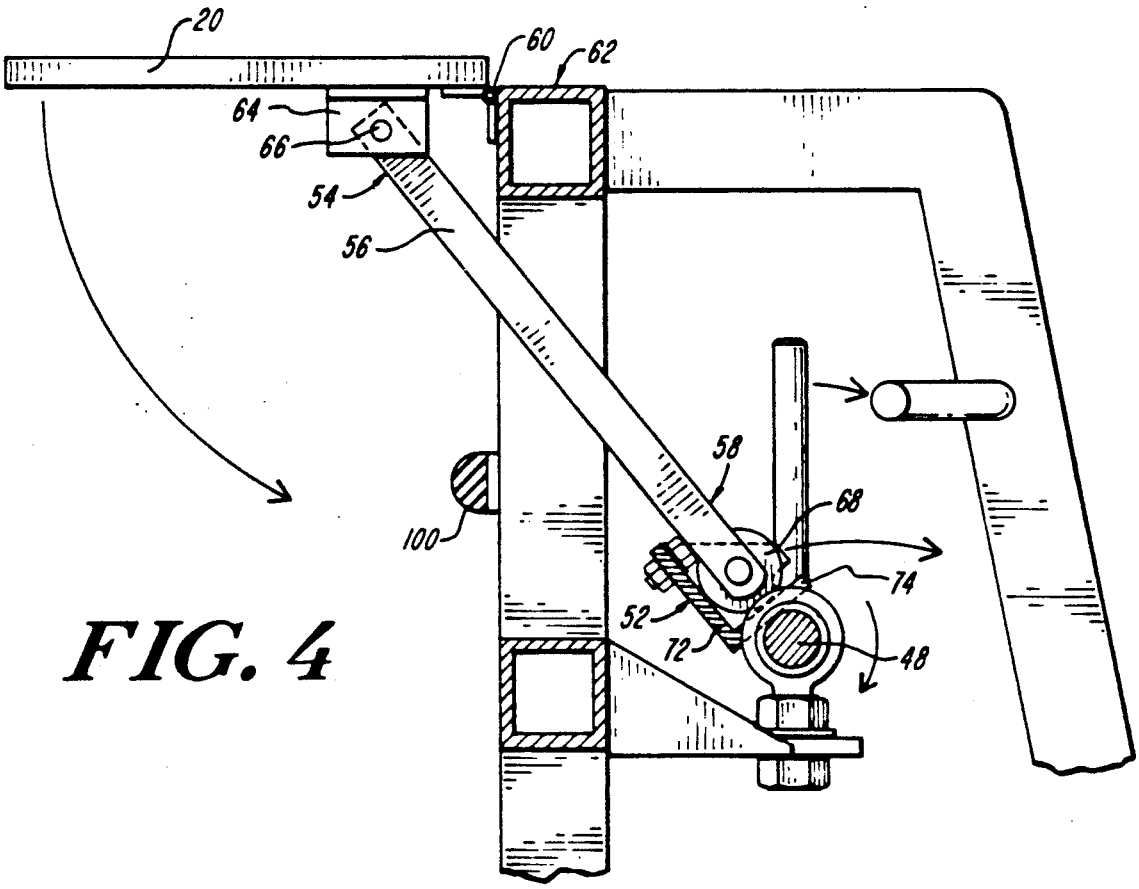
FIG. 4 is a side view showing the load-supporting platform of the apparatus depicted in FIGS. 1 through 3, in the load supporting condition.
Figure 5:
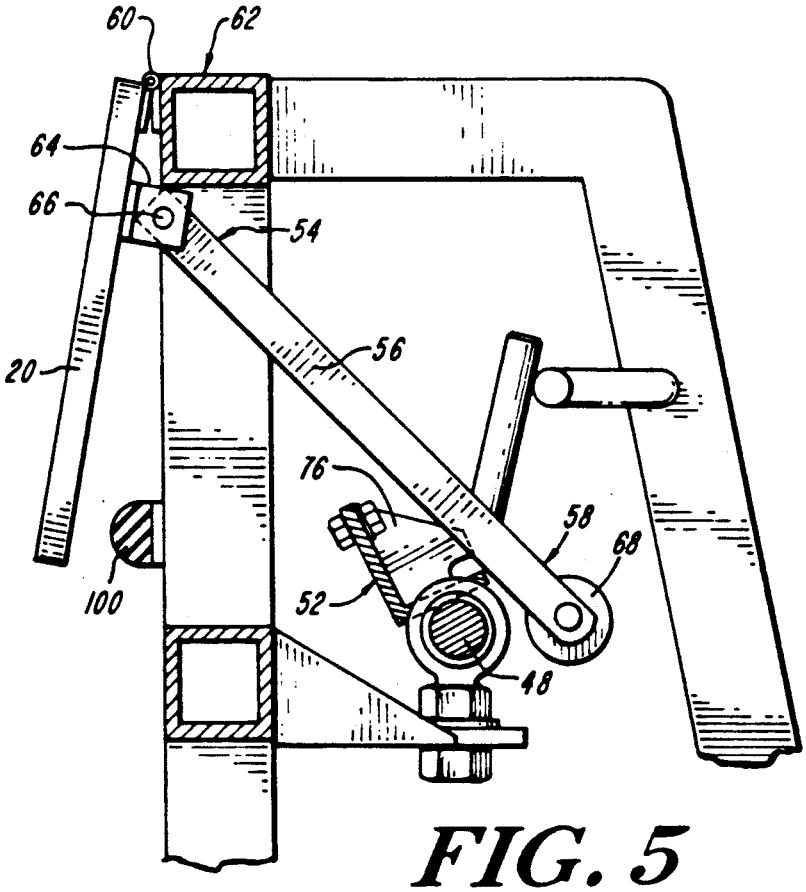
FIG. 5 is a side view showing the load-supporting platform of the apparatus depicted in FIGS. 1-3 in the load releasing condition.
Figure 6:
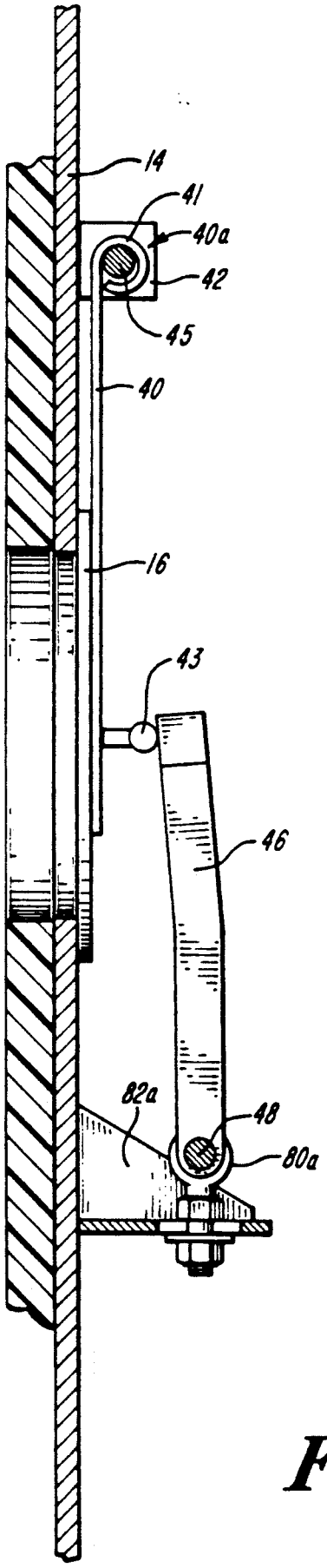
FIG. 6 is a side view showing a portion of the release mechanism of the invention.

FIGS. 3 through 6 illustrate the release mechanism useful with the dunking apparatus of the invention. As shown in FIGS. 3 and 6, the release mechanism includes one or more targets 16 which are positioned within an aperture 18 in target supporting wall 14. The targets 16 are held in place by a pivotal flange 40 which is secured to target supporting wall 14. Preferably, a top portion of flange 40 is pivotally secured to a bracket 42 joined to wall 14. The flange 40 extends downwardly from bracket 42 and is affixed to target 16 in order to provide vertical support to the target. A striking member 43 is preferably attached to a rear-facing side of flange 40, opposite target 16. Flange 40 and striking member 43 are adapted to communicate a force generated upon target displacement to a release actuator 44.

Release actuator 44 comprises an actuator flange 46 which, at its bottom portion **46*a*, is rigidly secured to a control member 48. Activator flange 46 extends upwardly from its point of connection to control member 48. Preferably, the activator flange 46 also curves inwardly (i.e., toward target, 16) and its top end 46*b*, which may comprise an attached counterweight, is positioned opposite striking member 43. The striking member 43 and end 46*b* of flange 46 are preferably separated by a predetermined distance (i.e., about 0.25 to 0.75 inch) when the target 16 and flange 40 are in the normal position. Displacement of the target 16 will cause the striking member 43 to contact, and thus displace actuator flange 46**.

As illustrated in FIG. 6, flange 40 has a curved upper portion **40*a*. In a preferred embodiment the upper portion 40*a* of flange 40 curves outwardly (i.e., away from the target 16) to form an aperture-like structure 41. Flange 40 is secured within bracket 42 by a dowel 45, or similar structure, which allows for pivotal movement of the flange. One advantage of the construction of flange 40 and its pivoting connection within bracket 42 is that after member 43 contacts flange 46 (as shown in FIG. 6) flange 40 returns to its normal position in which member 43 and flange 46** are separated.

Preferably, control member 48 is horizontally disposed and extends between the release actuator 44 for each target and the locking mechanism 52. The control member 48 may be a single, cylindrical rod which can be hollow or solid. As illustrated in FIG. 3, control member 48 preferably comprises at least two or more separate cylindrical rods which are joined together by one or more clasping devices 50, such as keyed universal joints. Clasping device 50 may be easily disengaged in order to allow for disassembly and easy transport of the control member 48. Also, one target may be rendered inoperable by disconnecting one of the clasping devices 50.

A locking mechanism 52 is affixed to a substantially central portion of the control member 48. The locking mechanism 52 is adapted to receive and selectively support a rearward end 58 of a support rod 56. A forward end 54 of support rod 56 is hingedly secured to the underside of load-supporting platform 20. Preferably, the load-supporting platform 20 is joined by hinges 60, or other means which allow for pivoting of the support platform, to a supporting frame 62. Frame 62 is preferably horizontally disposed and mounted on or within control housing 12. The bottom surface of Platform 20 also preferably includes a bracket 64 which, together with a pin 66, pivotally joins forward end 54 of the support rod 56 to platform 20.

The rearward end 58 of support rod 56 is adapted to be received by locking mechanism 52 until release of the platform is desired. No specific design for a rearward end 58 of support rod 56 is required. However, in a preferred embodiment forward end 58 comprises a friction reducing bearing 68 which is held in place by adjacent surfaces 70 of rod 56.

Locking mechanism 52 may be virtually any structure which is securely mounted upon control member 48. One requirement of locking mechanism 52, however, is that it be suitable to maintain the support platform 20 and the support rod 56 in the load-supporting condition at desired times. In a preferred embodiment, illustrated in FIGS. 3 through 5, the locking mechanism 52 is a cup-forming structure which is adapted to receive rearward end 58 and, when desired, to eject end 58. Locking mechanism 52 preferably comprises a forward-facing surface 72 which is oriented perpendicular a bottom wall 74 which is welded or otherwise securely affixed to control member 48. The locking mechanism may also have side walls 76, as shown in FIGS. 3 and 5, to house rearward end 58.

As noted, control member 48 is horizontally oriented and extends between targets 16. The control member 48 may be supported by a frame assembly 78 which preferably is disposed within the control housing 12. Preferably, a central portion of the control member extends through a central bushing 80 which is mounted upon a flange **82*b* secured to frame assembly 78. The central bushing 80*b* provides support for control member 48 but enables the rod to be rotated within the bushing. As bushing 80*b* is vertically oriented, it may be used to facilitate vertical adjustments to the control member 48** by tightening or loosening the nuts associated with the bushing.

Additional support for the control rod 48 may be provided by lateral bushings **80*a*, 80*c* which are mounted upon flanges 82***a*, 82*c* which extend from target supporting walls 14. Although FIG. 3 illustrates bushings 80*a*, 80*c* to be vertically oriented, bushings 80*a*, 80*c* may alternatively be horizontally oriented, so as to enable horizontal adjustment of the control member 48. Preferably, the bushings 80*a*, 80*c* are of sufficient diameter to allow for rotation of control member 48.

The clasp means 50, which may be used to join together separate portions of control member 48, may be virtually any device which enables separate joined sections which form control member 48 to be easily assembled, disassembled and rotated as a unit. In a prepared embodiment the clasp means 50 is a keyed universal joint. As shown in FIG. 3, the claps means 50 comprises U-shaped end portions 86 which are affixed end portions of segments 48*a*, *b*, *c*, of control apparatus 48. Each type of the U-shaped end portion 86 has an aperture within which a locking pin 88 may be disposed. Preferably, the clasp means also includes a ring member 90 which is disposed between the type 91 and which is adapted to receive locking pins 88.

As noted, the release activating mechanism includes targets 16, the target support flange 40, striking member 43, actuating flange 46, and the control member 48. The bottom end 46*a* of actuating flange 46 preferably is rigidly joined to the control member 48 such that any displacement of the flange 46 will result in rotation of control member 48.

The operation of the release mechanism is best illustrated by reference to FIGS. 3 through 6. FIGS. 3 and 4 illustrate platform 20 is in its load-supporting condition. As such, the rear end portion 58 of support rod 56 is firmly held within locking mechanism 52 by side walls 76 and bottom wall 74. The angle of orientation of the locking mechanism is such that under normal circumstances the support rod 56 will be held in place without releasing platform 20. When a target 16 is struck by a thrown object such as a ball, the target and striking member 43 are displaced rearwardly from target-supporting wall 14. As a result of this displacement, striking member 43 contacts actuating flange 46 which is likewise displaced. The displacement of the actuating flange results in a rotation of control member 48 in the direction shown by directional arrow 92. As the control member 48 rotates, the locking mechanism 52 likewise moves rearwardly in the direction shown by directional arrow 94. This movement of the locking mechanism causes the rearward end 58 of support rod 56 to be likewise moved in the rearward direction, and to eventually become ejected from the locking mechanism as illustrated in FIG. 5. Once the support rod 56 becomes disengaged from locking mechanism 52, platform 20 loses its support and pivots downwardly about its hinges 60. The net result of this action is that a load, or a person, supported upon the platform is dropped into reservoir 27.

A feature of the release mechanism of the invention is that the locking mechanism 52 firmly engages support rod 56 such that support rod 56 and platform 20 are not released absent a rotation of control member 48. Because rotation of the control rod 48 is effected only through an impact blow to the target 16, the force of an object striking the target-supporting wall 14 ordinarily will not release the platform 20. Moreover, member 48 rotates freely with minimal target displacement, and slight rotation of rod 48 is sufficient to cause locking mechanism 52 to eject the rearward end 58 of rod 56 and enable the friction reducing bearing of rod 56 to slide out of its housing, thereby releasing the platform.

In order to enable efficient operation of the release mechanism, a manual adjustment handle 96 may be rigidly affixed to control member 48. Preferably, handle 96 facilitates the resetting of the release mechanism, and also allows for manual release of the mechanism. The apparatus may also be provided with a ladder 98, or a similar stepping mechanism, which allows access to platform 20. In one embodiment, illustrated in FIGS. 3 through 5, a stop bar 100 may be affixed to the ladder. Preferably, the stop bar is positioned such that it will engage handle 96 upon release and rotation of member 48, thereby limiting the degree to which the control bar 48 rotates. As shown in FIGS. 4 and 5 a stopper 100 may be provided as part of the support frame to prevent platform 20 from directly striking the frame when it is released.

One skilled in the art will readily appreciate that the dunking apparatus and release mechanism of this invention may be constructed of a variety of suitable materials. Some portions of the dunking apparatus, such as the platform, housing and target-supporting wall, may be constructed of materials such as aluminum, steel, plastic or wood. Preferably, the moving parts of the release mechanism are constructed of steel or aluminum. However, it is conceivable that high strength polymeric materials may be used in the construction of these parts as well.

It is understood that various modifications may be made to the apparatus invention without departing from the scope of the invention. For example, although the apparatus is illustrated and disclosed to have two targets, it may easily be modified to have only one target or several other modifications will be apparent to one of ordinary skill in the art.

What is claimed is:

1. A release mechanism for an amusement apparatus adapted to release a load upon the occurrence of a predetermined event, comprising a load-supporting platform having load-supporting and load-releasing conditions;

an elongate support rod adapted to maintain the platform in the load supporting condition, a first end of said support rod being pivotally connected to a bottom surface of the load supporting platform;

a control apparatus comprising a horizontally disposed member rotatable about its longitudinal axis;

a locking mechanism secured to the control apparatus and adapted to receive and retain a second end of the support rod to facilitate the load-supporting condition of the platform, said locking mechanism moveable between load-supporting and load-releasing conditions upon rotational movement of the control apparatus; and impact responsive release activation means for imparting rotational movement to the control apparatus to facilitate movement of the locking mechanism from a load-supporting condition engaging the support rod to a load-releasing condition for releasing the support rod.

2. The release mechanism of claim 1 wherein the platform is a capable of supporting the weight of a human in the load-supporting condition.

3. The release mechanism of claim 1 further comprising a supporting frame to which a rearward-facing portion of the platform is hingedly connected.

4. The release mechanism of claim 2 wherein the second end of the support rod, releasably seated within the locking mechanism, comprises a bearing means for reducing friction between the support rod and the locking mechanism.

5. The release mechanism of claim 2 wherein the platform moves from its load-supporting to its load-releasing condition by the force of gravity when the support rod is unseated from the locking mechanism.

6. The release mechanism of claim 5 wherein the release locking mechanism comprises seating means for retaining one end of the support rod and preventing its release absent impact actuation of the release activation means.

7. The release mechanism of claim 6 wherein the activation means comprises:

a target apparatus;

an actuator flange responsive to target displacement and extending between a point adjacent the rear portion of the target and a control member; and a rotatable, horizontally oriented control member which extends between the actuator flange and the support means.

8. The release mechanism of claim 7 wherein the release activation means comprises a plurality of targets and associated actuation flanges, wherein the control member extends between each actuation flange and the support means.

9. The release mechanism of claim 8 wherein the actuator flange is secured to the control member such that displacement of the actuator flange causes rotation of the control member and unseating of the support means from the locking mechanism.

10. The release mechanism of claim 9 wherein the locking mechanism is permanently secured to the control member.

11. The release mechanism of claim 9 wherein the target is displaceable upon impact with a thrown object.

12. A load-dunking amusement device, comprising a reservoir for supporting a fluid or other material into which a load may be dunked;

a load-supporting platform disposed over the reservoir and moveable between load-supporting and load-releasing conditions;

at least one target-supporting wall hingedly connected to the control area housing;

release means for releasing the platform from the load-supporting condition to the load-releasing condition, said release means comprising an elongate support rod adapted to maintain the platform in the load-supporting condition, a control apparatus comprising a horizontally disposed member rotatable about its longitudinal axis, and a locking mechanism secured to the control member and adapted to receive a portion of the support rod to facilitate the load-supporting condition of the platform, the locking mechanism being moveable between load-supporting and load-releasing conditions, and impact responsive release actuation means for imparting rotational movement to the control apparatus to facilitate movement of the locking mechanism from a load-supporting condition engaging the support rod to a load-releasing condition for releasing the support rod; and a wheeled, transportable base upon which the device is mounted.

13. The amusement device of claim 12 further comprising an enclosure means for protecting the platform and reservoir from thrown objects.

14. The amusement device of claim 11 further comprising a membrane supported by a plurality of support posts, disposed forward of the platform and enclosure means.

15. The amusement device of claim 11 wherein the transportable base comprises a wheel-based, mobile trailer apparatus.

* * * * *